United States Patent [19]

Hughes

[11] Patent Number: 4,511,134

[45] Date of Patent: Apr. 16, 1985

[54] LOCKOUT FOR A ROTARY FEEDER

[75] Inventor: Charles C. Hughes, Villa Hills, Ky.

[73] Assignee: R. A. Jones & Co. Inc., Covington, Ky.

[21] Appl. No.: 527,016

[22] Filed: Aug. 29, 1983

[51] Int. Cl.[3] ..... B65H 3/28

[52] U.S. Cl. ..... 271/113; 271/117; 271/31.1; 221/151; 221/277

[58] Field of Search ..... 271/2, 21, 22, 23, 30 A, 271/101, 113, 117, 118, 136; 221/151, 277; 414/330, 129

[56] References Cited

U.S. PATENT DOCUMENTS 3,051,477 8/1962 Pavlic ..... 271/136
3,160,293 12/1964 Hennequin ..... 271/2
3,411,768 11/1968 Gatti ..... 271/117
3,650,525 3/1972 Hageman et al. ..... 271/113
4,429,864 2/1984 Scarpa et al. ..... 271/97

*Primary Examiner*—Bruce H. Stoner, Jr.
*Assistant Examiner*—James E. Barlow
*Attorney, Agent, or Firm*—Wood, Herron & Evans

[57] ABSTRACT

In carton feeding apparatus, a rotary member having a blade which passes behind a leading carton in a group of vertically-oriented cartons to separate the leading carton from the adjacent carton. A lockout member is pivotally mounted on the rotary member and is adapted to be moved in a generally axial direction toward the incoming cartons to block the cartons from engagement by the blade.

4 Claims, 9 Drawing Figures

LOCKOUT FOR A ROTARY FEEDER

This invention relates to carton feeding apparatus for a cartoning machine, and more specifically, the invention relates to a device for blocking the operation of the feeder so as to discontinue, at least momentarily, the feeding of the cartons.

In cartoning apparatus, cartons are fed from a magazine after which they are erected and placed between transport lugs on a continuously-moving endless carton conveyor. Product buckets mounted on a product bucket conveyor are conveyed alongside the cartons and in alignment with the cartons. A barrel loader mechanism is provided with a plurality of pusher heads, each pusher head being cammed to slide through the product bucket and thereby push the product from the product bucket into the carton.

In copending application Ser. No. 276,081, filed June 22, 1981, now U.S. Pat. No. 4,429,864, a rotary carton feeder is described. The magazine for that feeder has a generally horizontal conveyor slightly inclined away from the feeder. The flat folded cartons are stacked in a generally vertical orientation, leaning slightly forward, and their top edges are urged into engagement with the feeder.

The feeder is a continuously-rotating member located at the upper edges of the cartons. The feeder has a blade with a leading edge which is adapted to swing behind a leading carton leaning against the feeder and to separate it from its adjacent carton. The body of the feeder has a generally helical channel through which the upper edge of the leading carton passes. Until it is released at the trailing edge of the blade, the adjacent carton as well as those upstream of it are held back by the body of the feeder. As the blade completes a 360° excursion, another carton is picked off. The feeder reliably operates to separate a leading carton from the stack every 360° of rotation of the feeder.

It is desirable to provide a reliable device for blocking the feeding action of the feeder. The principal reason for blocking the action of the feeder arises from the fact that the carton feeder normally runs of the order of 20% faster than the product is produced. Thus, approximately every sixth product bucket will be empty. If a carton is fed into the transport lugs adjacent the empty product bucket, it would have to be thrown away when discharged from the end of the cartoner.

To eliminate such waste, a mechanism such as a photoelectric detector is provided to detect the absence of a product in a bucket and to actuate a control which blocks the feeding of a carton into the corresponding transport lugs until the electric eye or other device detects the presence of a product in the product bucket.

In the copending application Ser. No. 276,081, now U.S. Pat. No. 4,429,864, the locking out mechanism consists of a pneumatically-actuated plunger located adjacent the upper edge of the leading carton in the stack. When the absence of product is detected, the plunger is thrust downwardly alongside the feeder to force the carton blanks rearwardly or upstream a sufficient distance so that the blade on the feeder cannot slip behind the leading carton in the stack. The plunger works satisfactorily, but it has its disadvantages.

When small cartons are run, it is difficult to get the plunger in between the cartons to stop the feed. Since the plunger must necessarily be alongside the rotary feeder and hence engage the upstream cartons adjacent the vertical edges, there is a possibility that the adjacent carton will be bowed toward the feeder, putting its top edge in position to be inadvertently engaged by the metering blade. The plunger has to force the adjacent carton a substantial distance, for example, ⅜", away from the rotary feeder. This action tends to buckle the carton, pushing its upper edge downwardly. When the plunger is released, there is a possibility of the feeder engaging the next adjacent carton, thus feeding two cartons.

To block out the cartons, about a one-inch stroke of the plunger is necessary. At show speeds this presents no problem, but if cartons are being run at the rate of 850 per minute, for example, they could not effectively be blocked out with the plunger.

Finally, the plunger has only about 200° of cycle time to effect the blocking out of the carton, and this tends to make timing rather critical.

It has been an objective of the present invention to improve upon the blocking out mechanism of the prior invention and to provide a lockout which is reliable at very high carton-feeding rates and to eliminate the disadvantages referred to above.

This objective of the invention is attained by providing an axially-movable arcuate element on the body of the feeder adjacent the blade. A plunger mounted on the feeder housing is engageable with the downstream surface of the arcuate element to swing it generally axially toward the incoming cartons. When its forward surface passes axially beyond the axial position of the blade, it engages the cartons and effectively holds them against such forward movement as would enable the blade to engage them.

Since the arcuate element is on the feeder immediately adjacent the blade, there is no possibility of bowing a carton or buckling a carton when it is actuated, thereby avoiding the disadvantages of the prior plunger lockout mechanism. Additionally, the timing is not as critical in that the configuration of the feeder elements is such that about 355° of cycle time is available to effect the lockout. Thus, the feeding of cartons at 850 per minute with effective lockout presents no problem.

The prior plunger lockout mechanism limited the minimum size carton to approximately a 6" depth (the horizontal dimension perpendicular to the movement of the cartons) because a standard feeder wheel of 5" diameter would not leave enough of a laterally-projecting carton edge for engagement by the plunger. In accordance with the present invention, the same 5" feeder wheel can run cartons in the range of 2¾" to 9" in depth.

Finally, the movable lockout element of the present invention is effective to lock out the feeding of cartons regardless of the pressure of the upstream stack, whereas with the prior plunger mechanism, an improperly set-up machine allowing the full weight of the stack on the feeder would be almost impossible to drive back away from the feeder by means of the plunger.

The several features and objectives of the invention will become more readily apparent from the following detailed description taken in conjunction with the accompanying drawings in which.

FIGS. 4*a* to 4*f* are diagrammatic perspective views of the metering wheel illustrating its cooperation with the cartons to illustrate the feeding and lockout operations.

Figure 1:
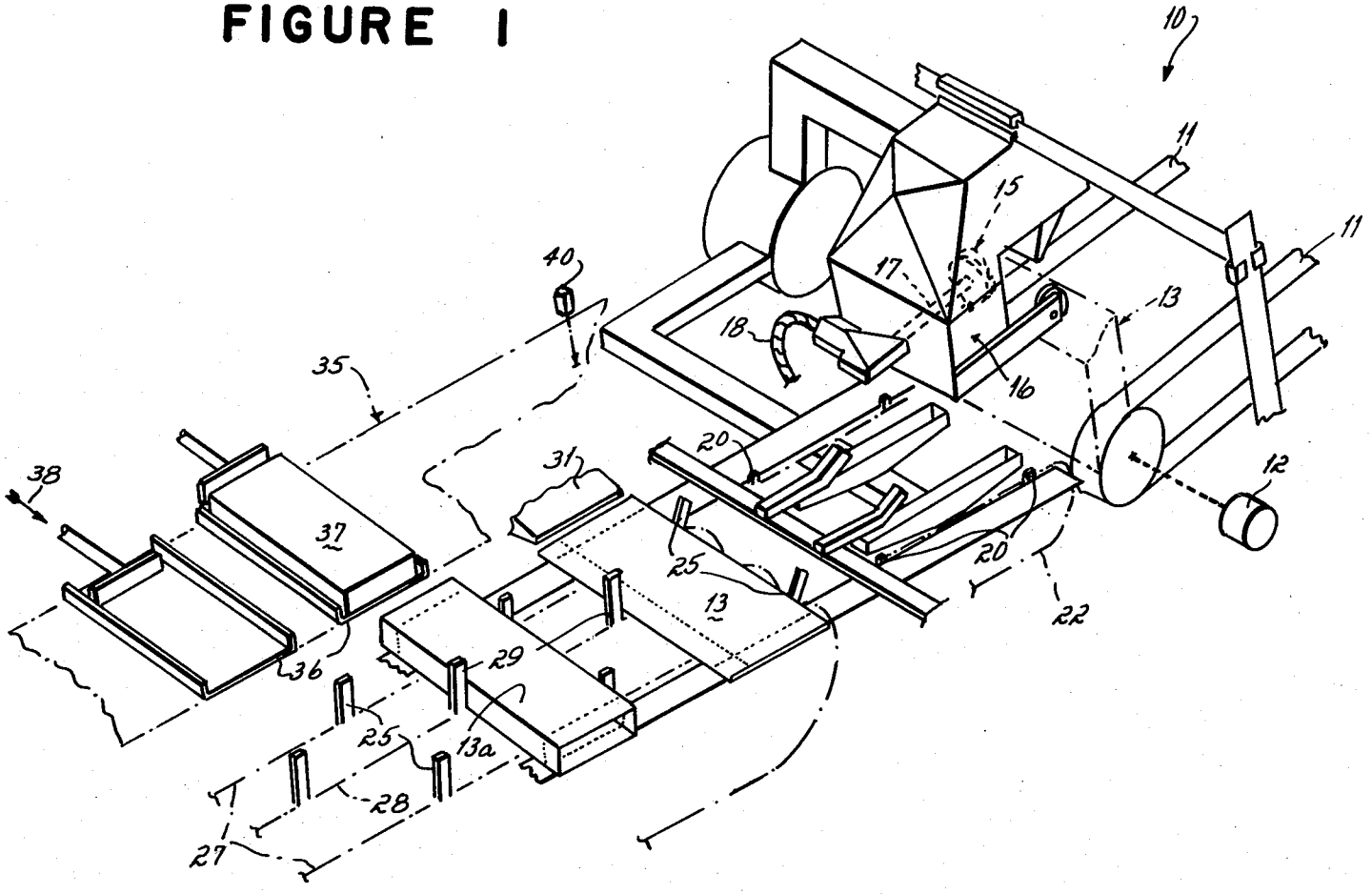
FIG. 1 is a fragmentary perspective view of a cartoner employing the present invention.
Figure 2:
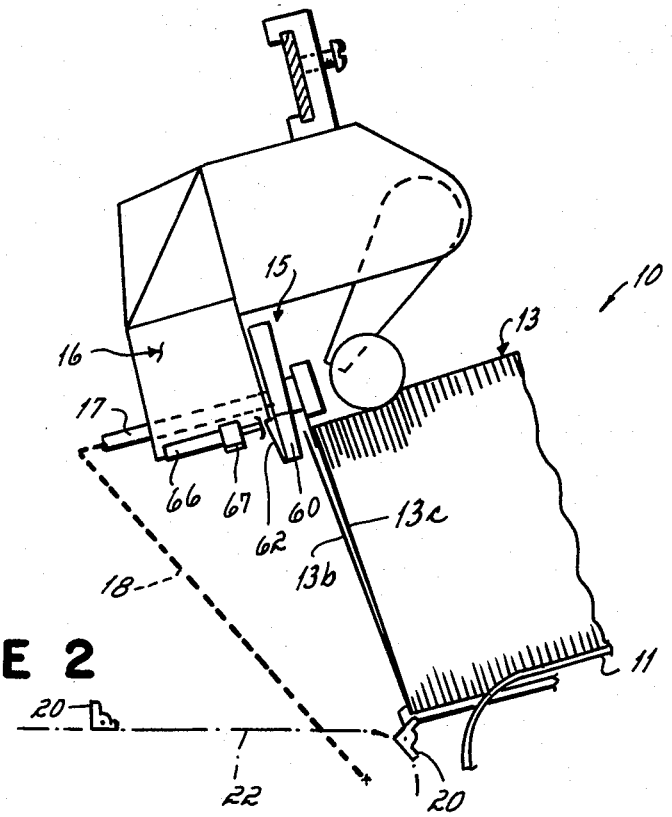
FIG. 2 is a fragmentary side elevational view of the magazine and feeder.

Referring to FIG. 1, which is a fragmentary perspective view of a cartoner and to FIG. 2, there is shown a magazine 10 including conveyor chains 11 which are intermittently operated on demand by a motor 12 to carry a stack of cartons 13 forward toward the metering wheel 15. The conveyor chains are preferably of the type disclosed in copending application Ser. No. 441,377 filed Nov. 12, 1982. The metering wheel 15 is mounted on a housing 16 and is driven from a shaft 17 which is connected to a flexible cable 18. The flexible cable is driven off the cartoner drive so as to be in synchronism with it. The housing contains blowers which drive each released flat carton blank downwardly to a generally horizontal position between feeder lugs 20. The feeder lugs are mounted on a pair of chains 22 which are continuously driven so as to move the lugs in a forward direction to carry the cartons into a position where they can be picked up by transport lugs 25 mounted on a transport conveyor 26. The transport conveyor has two outer chains 27 which carry trailing lugs and a center chain 28 which carries a leading lug 29. A blower 31 blows air into each carton 13 as it passes by to cause it to pop up to an erected condition between the lugs 27 and 28 as shown at 13*a*.

Alongside the transport conveyor 26 is a product bucket conveyor 35 having spaced product buckets 36. Each product bucket 36 is aligned with a set of transport lugs so that product 37 can be driven in the direction of the arrow 38 into an erected open carton by means of a conventional barrel loader, not shown.

A photoelectric detector 40 is diagrammatically shown in FIG. 1 and operates to detect the presence or absence of product in each product bucket. When no product is present, the detector 40 will cause the operation of the lockout mechanism to block out the feed of the carton associated with the empty product bucket.

Figure 3:
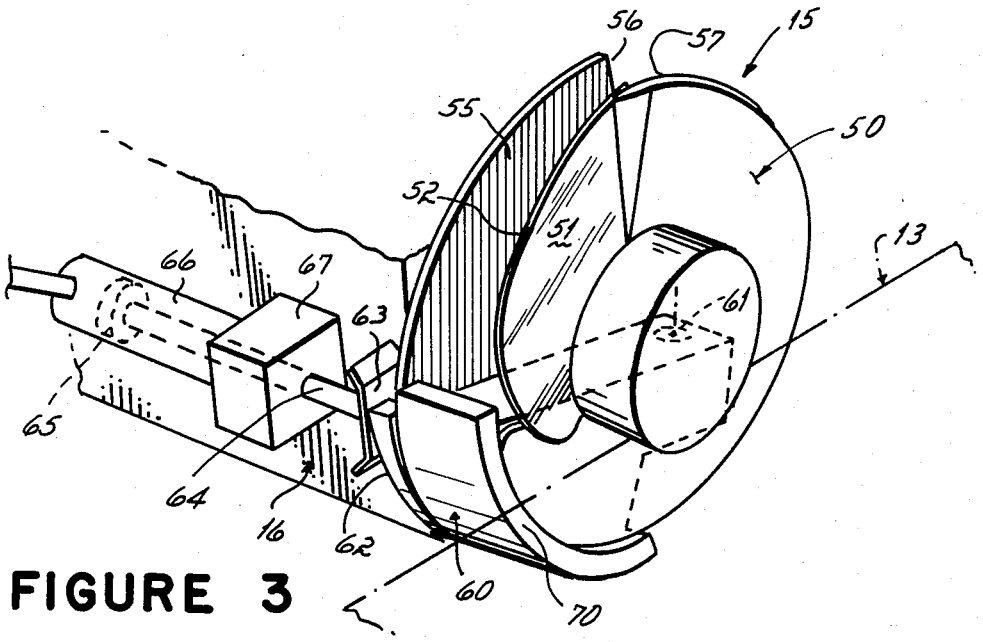
FIG. 3 is a perspective view of the metering wheel of the feeder.

The metering wheel and lockout mechanism are best shown in FIGS. 2 and 3. The metering wheel 15 includes a body 50 on which a blade 51 is mounted. The blade 51 has an arcuate edge 52 which is adapted to slice between the leading carton 13*b* and the next adjacent carton 13*c* shown in FIG. 2. A release plate 55 is mounted on the downstream side of the body and has a trailing edge 56 which must rotate past the upper edge of the carton in order for the carton to pass the metering wheel and be blown down between the feed lugs 20 on the chains 22.

The downstream face 57 of the body 50 presents a helical surface, best seen by reference to FIGS. 4*a* to 4*e* which, upon rotation of the metering wheel, moves the upper edge of the carton, picked off by the blade 51, away from the stack in the magazine. At normal operating speeds, the release plate does not interfere with the pivoting of the cartons as they fall from the metering wheel to the lugs 20. However, at start-up, when the mechanism is moving relatively slowly, it is important to hold the blank back through the use of the release plate, thereby timing its drop to a proper position with respect to the lugs 20.

Figure 4A:
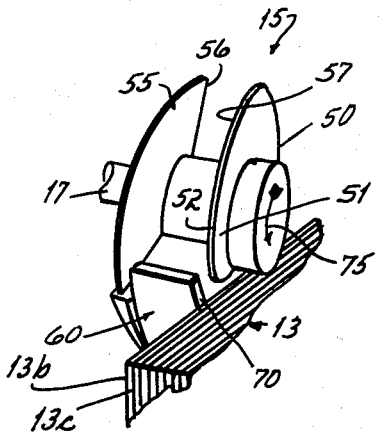
Figure 4B:
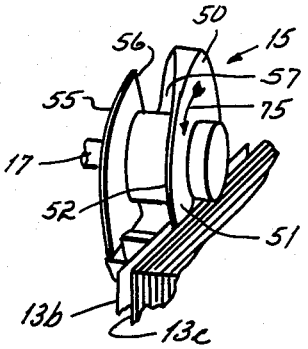
Figure 4C:
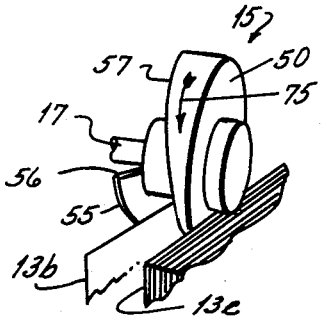
Figure 4D:
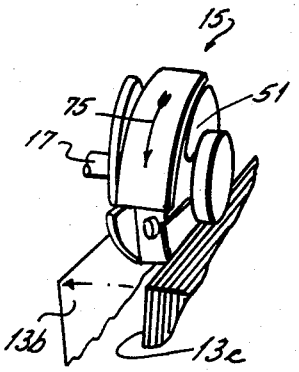
Figure 4E:
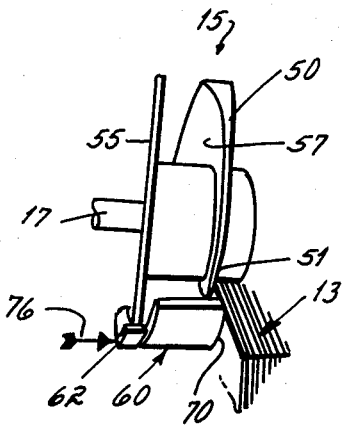
Figure 4F:
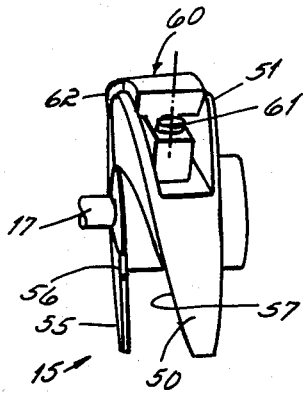

As best shown in FIGS. 3 and 4*f*, a lockout element 60 is pivotally mounted by a stud or shoulder screw 61 to the body 50 of the metering wheel. On the downstream side of the metering wheel, the lockout element presents a cam surface 62 which is engageable by a plate 63 mounted on a plunger 64 forming part of a pneumatic piston 65 and cylinder 66. The cylinder 66 is mounted on a block 67 which is in turn mounted on a part of the housing 16.

The opposite side of the lockout element 60 presents a lockout surface 70 which is adjacent the blade 51 (FIG. 4*e*). When the plunger 64 has been actuated to cam the lockout element toward the stack of cartons in the magazine, the lockout surface 70 projects axially beyond the blade 52 and is operative to hold the leading carton away from the blade so that it cannot be separated from the stack. When the plunger is retracted, the lockout element is free to pivot to an inoperative position away from the stack. When forced to that position by the pressure of the stack, the blade is free to engage the leading carton and separate it from the stack.

The plunger is operatively connected through a control means, not shown, to engage the lockout element when the photoelectric detector 40 detects the absence of a product in the product bucket 36.

The operation of the invention is best understood by reference to FIGS. 4*a* to 4*e*. The cartons 13 in the stack are generally vertically oriented, having a slightly forwardly-inclined attitude at illustrated in FIG. 2. The pressure of the cartons in the stack as well as air from the blowers in the housing 16 tend to urge the leading carton 13*b* against the metering wheel 15. As shown in FIG. 4*a*, the lockout element 60 is in its inoperative position, having been pivoted by the pressure of the stack toward the downstream direction. The metering wheel rotates in the direction of the arrow 75. As the wheel continues to rotate to the position shown in FIG. 4*b*, the blade edge 52 of the blade 51 enters the space between the leading carton 13*b* and the next adjacent carton 13*c* and begins the separation of the carton from the stack.

Further rotation of the metering wheel is illustrated in FIG. 4*c*. It can be seen that the leading carton 13*b* has been moved well away from the stack and as soon as the trailing edge 56 of the release plate 55 passes the carton, it will be free to fall forward and thereafter be blown down to the feed lugs 20, the carton about to fall being illustrated in FIG. 4*d*.

In the event that the absence of product is detected, the plunger 64 will be urged toward the right, in an upstream direction indicated by the arrow 76, and will cause the lockout element 60 to pivot in a generally axial direction past the blade 51. The surface 70 of the lockout element will act upon the stack to force the leading carton axially away from the metering wheel a distance sufficient to prevent the blade 51 from passing between the leading carton and the next adjacent carton. As soon as the pressure of the plunger is released, the force of the stack leaning against the metering wheel will cause the lockout element 62 to return to its inoperative position illustrated in FIGS. 4*a* and 4*b*.

Having described my invention, I claim:

1. A rotary feeder for sheets such as flat folded cartons comprising, a hub, a blade mounted on said hub to pass behind a leading sheet to separate it from the adjacent sheet, a lockout element movably mounted on said hub, said lockout element, when extended axially, projects beyond said blade, thereby engaging a leading sheet and holding it out of engagement by said blade.

2. In a cartoner having a product bucket conveyor, and an erected carton conveyor running alongside said product bucket conveyor, carton feeding apparatus comprising, an infeed conveyor for carrying cartons in a generally vertical orientation, a rotary feeder above the downstream end of said conveyor, said rotary feeder comprising, a housing, a rotary hub mounted on said housing for rotation about an axis generally parallel to the direction of movement of said conveyor, a blade projecting from said hub and adapted to pass behind a leading carton to separate it from the adjacent carton, a lockout member mounted for generally axial movement on said hub, and means for moving said lockout member in an upstream direction when a product bucket is empty to force a leading carton away from said blade.

3. Carton feeding apparatus as in claim 2 in which said lockout member is arcuate and is pivoted on said hub adjacent said blade.

4. Carton feeding apparatus as in claims 2 or 3 in which said moving means comprises, a piston and cylinder mounted on said housing on an axis parallel to said hub axis, said piston having a head adjacent to said lockout member and engageable with it when said piston and cylinder is actuated.

* * * * *